US006545568B2

(12) United States Patent
Mizoguchi et al.

(10) Patent No.: US 6,545,568 B2
(45) Date of Patent: Apr. 8, 2003

(54) DUAL-MODE BAND-PASS FILTER

(75) Inventors: Naoki Mizoguchi, Shiga-ken (JP); Hisatake Okamura, Nagaokakyo (JP); Seiji Kamba, Kusatsu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/901,860

(22) Filed: Jul. 10, 2001

(65) Prior Publication Data

US 2002/0005770 A1 Jan. 17, 2002

(30) Foreign Application Priority Data

Jul. 12, 2000 (JP) ..... 2000-211662

(51) Int. Cl.[7] ..... H01P 1/203
(52) U.S. Cl. ..... 333/204; 333/219
(58) Field of Search ..... 333/204, 202, 333/205, 134, 219

(56) References Cited

U.S. PATENT DOCUMENTS

| | | | | |
|---|---|---|---|---|
| 5,659,274 A | * | 8/1997 | Takahashi et al. | 333/204 |
| 6,218,915 B1 | * | 4/2001 | Schallner | 333/219 |
| 6,326,865 B1 | * | 12/2001 | Kundu et al. | 333/202 |

FOREIGN PATENT DOCUMENTS

| | | |
|---|---|---|
| JP | 06-112701 | 4/1994 |
| JP | 09-139612 | 5/1997 |
| JP | 09-162610 | 6/1997 |

* cited by examiner

*Primary Examiner*—Michael Tokar
*Assistant Examiner*—Vibol Tan
(74) *Attorney, Agent, or Firm*—Keating & Bennett, LLP

(57) ABSTRACT

A dual-mode band-pass filter having a greatly reduced size and a high design flexibility, includes a frame-shaped electrode pattern disposed on one surface or inside a dielectric substrate. A pair of input-output circuits are coupled to the frame-shaped electrode pattern. The plane shape and the line-width of the frame-shaped electrode pattern are configured so that two generated resonance modes are coupled to each other.

11 Claims, 11 Drawing Sheets

DUAL-MODE BAND-PASS FILTER

BACKGROUND OF THE INVENTION

1. Field of the Invention

The present invention relates to a method of controlling the band-width of a dual mode band-pass filter for use as a band filter in a communication device operated in a microwave band to a millimeter wave band, and also relates to a dual mode band-pass filter.

2. Description of the Invention

Various conventional band-pass filters, for use in a high frequency region, have been proposed, for example, in MINIATURE DUAL MODE MICROSTRIP FILTERS, J. A. Curtis and S. J. Fiedziuszko, 1991 IEEE MTT-S Digest.

FIGS. 13 and 14 are schematic plan views showing conventional dual-mode band-pass filters, respectively.

In a band-pass filter 200 shown in FIG. 13, a circular conductive film 201 is provided on a dielectric substrate (not shown). An input-output coupling circuit 202 and an input-output coupling circuit 203 are coupled to the conductive film 201 at an angle of 90° with respect to each other. A top-open stub 204 is provided at a location so as to define a center angle of 45° relative to the location where the input-output coupling circuit 203 is disposed. Thereby, two resonance modes having different resonance frequencies are coupled. As a result, the band-pass filter 200 operates as a dual-mode band-pass filter.

Moreover, in a dual-mode band-pass filter 210 shown in FIG. 14, a substantially square conductive film 211 is provided on a dielectric substrate. Input-output coupling circuits 212 and 213 are coupled to the conductive film 211 at an angle of 90° with respect to each other. The corner portion positioned at an angle of 135° relative to the input-output coupling circuit 213 is cut away. With the cut away portion 211*a*, the resonance frequencies of the two resonance modes are different. The two resonance modes are coupled to each other, and thereby, the band-pass filter 210 operates as a dual-mode band-pass filter.

Moreover, a dual-mode band-pass filter having a circular ring-shaped conductive film instead of the circular conductive film is disclosed in Japanese Unexamined Patent Application Publication No. 9-13961 and Japanese Unexamined Patent Application Publication No. 9-162610. That is, a dual mode filter is disclosed in which a circular ring-shaped ring-transmission line is provided, and input-output coupling circuits are arranged to form a center angle of 90° therebetween, in addition to those in the dual-mode band-pass filter shown in FIG. 13. Moreover, a top-open stub is provided in a portion of the ring-shaped transmission line.

In each of the conventional dual-mode band-pass filters shown in FIGS. 13 and 14, the two-stage band-pass filter is constructed to include one conductive film pattern. Accordingly, the band-pass filters are miniaturized.

However, in two-stage band-pass filter having circular or square conductive film patterns, the input-output coupling circuits separated from each other by the above-mentioned particular angles are coupled. Therefore, it is impossible to enhance the coupling degree, and a wide transmission band cannot be achieved.

Moreover, in the band-pass filter shown in FIG. 13, the conductive film 201 has a circular shape. In the band-pass filter of FIG. 14, the conductive film 211 has a substantially square shape. That is, the conductive films are limited to these particular shapes. Accordingly, the design flexibility is greatly reduced.

Moreover, each of the above-described band-pass filters has a frequency band that operates in only one resonance mode. Thus, it is difficult to control the frequency band, due to the restrictions of the circular or square conductive film shapes.

SUMMARY OF THE INVENTION

To overcome the above-described problems with the prior art, preferred embodiments of the present invention provide a method of controlling the band-width of a dual-mode band-pass filter, in which the above-described defects of the conventional techniques are eliminated, miniaturization is achieved, reduction in size and realization of a wide band-width is achieved, and the design flexibility is greatly increased. Also, preferred embodiments of the present invention provide the dual-mode band-pass filter produced by this method.

According to preferred embodiments of the present invention, a dual-mode band-pass filter includes a dielectric substrate, a frame-shaped electrode pattern provided on one main surface of the dielectric substrate or inside the dielectric substrate, the frame-shaped electrode pattern including a line-shaped electrode having a substantially constant line-width from the starting point to the end point, the starting point and the end point being connected to each other, a ground electrode provided inside the dielectric substrate or on a main surface of the dielectric substrate and opposed to the frame-shaped electrode pattern via a portion of the dielectric substrate, and input-output coupling circuit electrodes coupled to the frame-shaped electrode pattern, at least one of a capacitance loading portion and an inductance loading portion being provided in a portion of the line-shaped electrode such that two resonance modes having different resonance frequencies and being generated at the frame-shaped electrode pattern are coupled to each other.

Preferably, the frame-shaped electrode pattern has a substantially rectangular or rhombic electrode pattern having four sides.

Also, preferably, the electrode widths of two adjacent sides of the four sides are different from each other, and the electrode widths of two opposed sides of the four sides are the same. Convex portions that function as the capacitance adding portions or concavities which function as the inductance adding portions are provided on two opposed sides of the four sides. Furthermore, the electrode lengths of two adjacent sides of the four sides are different from each other, and the electrode lengths of two opposed sides thereof are the same. The electrode including at least one side of the four sides preferably has a tapered shape.

Also, preferably, at least one corner portion of the four corner portions of the substantially rectangular or rhombic electrode pattern is bent.

Other features, steps, elements, characteristics and advantages of the present invention will become more apparent from the following detailed description of preferred embodiments with reference to the attached drawings.

DETAILED DESCRIPTION OF PREFERRED EMBODIMENTS

Figure 1:
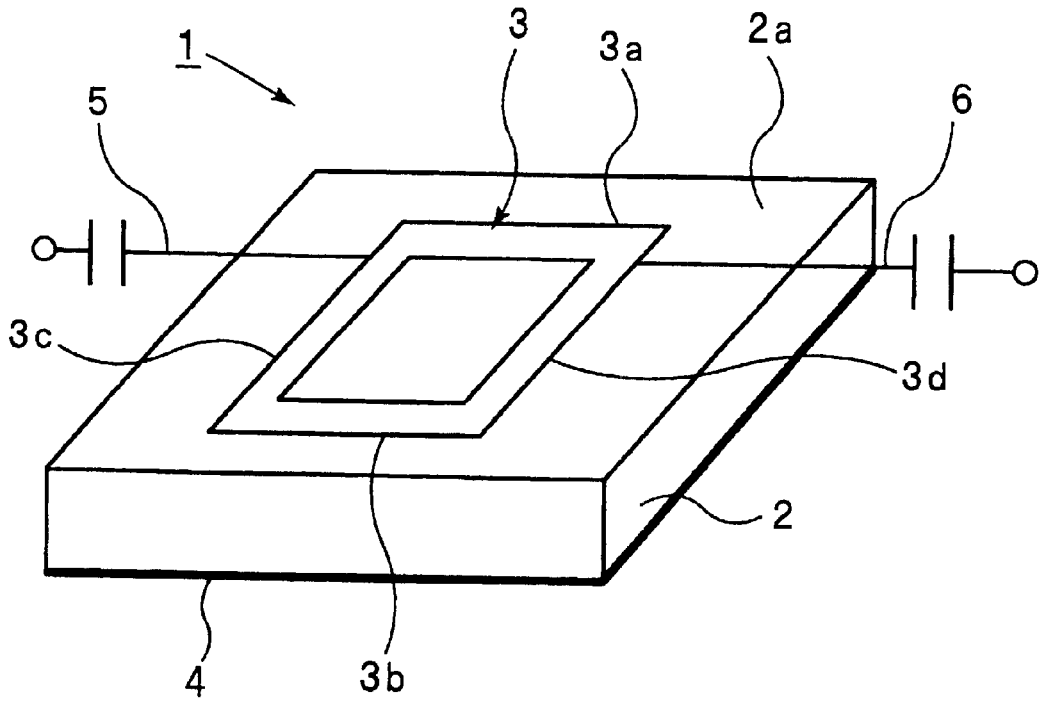
FIG. 1 is a perspective view showing a dual-mode band-pass filter according to a first preferred embodiment of the present invention.
Figure 2:
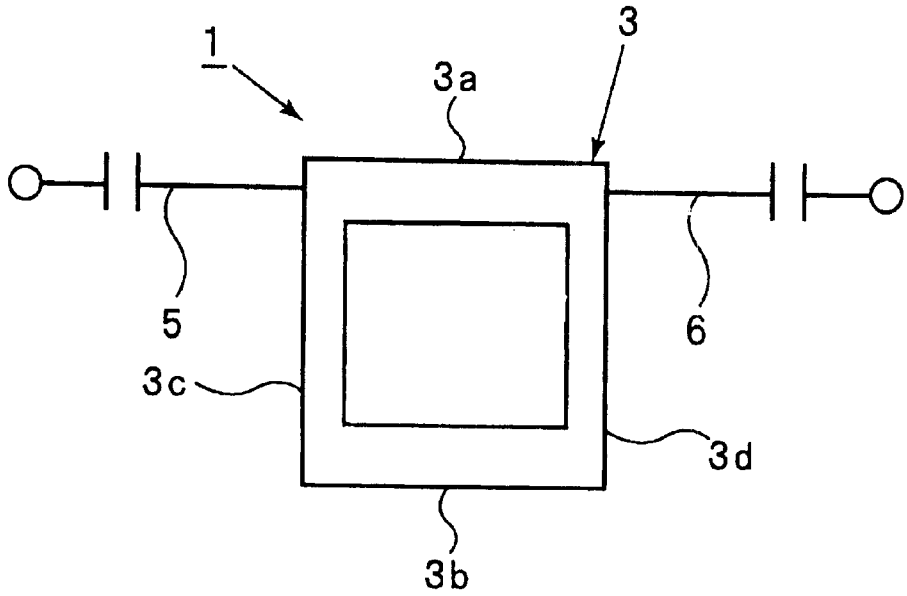
FIG. 2 is a schematic plan view showing the essential portion of the dual-mode band-pass filter of the first preferred embodiment of the present invention.

FIG. 1 is a perspective view showing a dual-mode band-pass filter according to a first preferred embodiment of the present invention. FIG. 2 is a plan view schematically showing the essential portion of the filter.

The dual-mode band-pass filter 1 has a dielectric substrate 2 preferably having a substantially rectangular plate shape. In this preferred embodiment, the dielectric substrate 2 is preferably made of a ceramic material with a relative dielectric constant $\epsilon r=6.27$, and which includes as a major component, oxides of Ba, Al, and Si. In this preferred embodiment and other preferred embodiments, the dielectric substrate 2 may be made of any appropriate dielectric materials such as synthetic resins, e.g., fluororesins or other suitable materials.

The thickness of the dielectric substrate 2 has no particular limitations. In this preferred embodiment, the thickness is approximately 300 $\mu$m but other thicknesses may be used.

A frame-shaped metal film 3 is arranged on the upper surface 2*a* of the dielectric substrate 2 to define a resonator. The frame-shaped electrode pattern 3 is provided on a portion of the upper surface 2*a* of the dielectric substrate 2, is a line-shaped electrode having a substantially constant line-width from the starting point to the end point thereof, and has a substantially rectangular ring-shape in which the starting point is connected to the end point. In this preferred embodiment, the external shape is preferably substantially square and preferably has approximate dimensions of 2.0 mm×2.0 mm. The line widths of the line-shaped electrodes are different between one pair of two opposed sides 3*a* and 3*b* and the other pair of two opposed sides 3*c* and 3*d*. That is, the line-width of sides 3*a* and 3*b* is preferably about 200 $\mu$m, and the line-width of sides 3*c* and 3*d* is preferably about 100 $\mu$m. In particular, the line-width is defined as the dimension in the width-direction of the metal film portion along each side of the substantially rectangular frame-shaped metal film 3.

In this preferred embodiment, the line-width of the sides 3*a* and 3*b* is preferably about 200 $\mu$m, and the line-width of the sides 3*c* and 3*d* is preferably about 100 $\mu$m. That is, for the purpose of coupling the two resonance modes caused in the electrode pattern 3, the line-widths are different between the sides 3*a* and 3*b* and the sides 3*c* and 3*d*. In other words, the line-widths of the sides 3*a* and 3*b* and those of the sides 3*c* and 3*d* are selected such that two resonance modes having different resonance frequencies are produced in the frame-shaped electrode pattern 3 defining a resonator, and the two resonance modes are degeneration-coupled to each other to produce a band-pass filter. This will be described later with respect to specific experimental data.

Moreover, a ground electrode 4 is provided on the entire bottom surface of the dielectric substrate 2. Input-output coupling circuit electrodes 5 and 6 are provided for the electrode pattern 3 having a predetermined gap therebetween. In this preferred embodiment, the input-output coupling circuit electrodes 5 and 6 preferably includes metal films provided in predetermined gaps in a pair of the sides 3*c* and 3*d* of the electrode pattern 3 on the upper surface of the dielectric substrate 2, respectively, though not particularly shown. That is, the input-output coupling circuit electrodes 5 and 6 are capacitance-coupled to the electrode pattern 3. The nodes of the input-output coupling circuit electrodes 5 and 6 are positioned on the sides 3*c* and 3*d* at a distance of about 50 $\mu$m from the ends of the side 3*a*, respectively.

In this preferred embodiment, an input voltage is applied between one of the input-output circuits 5 and 6 and the ground electrode 4, and thereby, an output is produced between the other of the input-output circuits 5 and 6 and the ground electrode 4. In this case, since the frame-shaped electrode pattern 3 has the above-described shape, the two resonance modes generated in the frame-shaped electrode pattern 3 defining the resonators are coupled to each other, such that the filter operates as a dual-mode band-pass filter.

Figure 3:
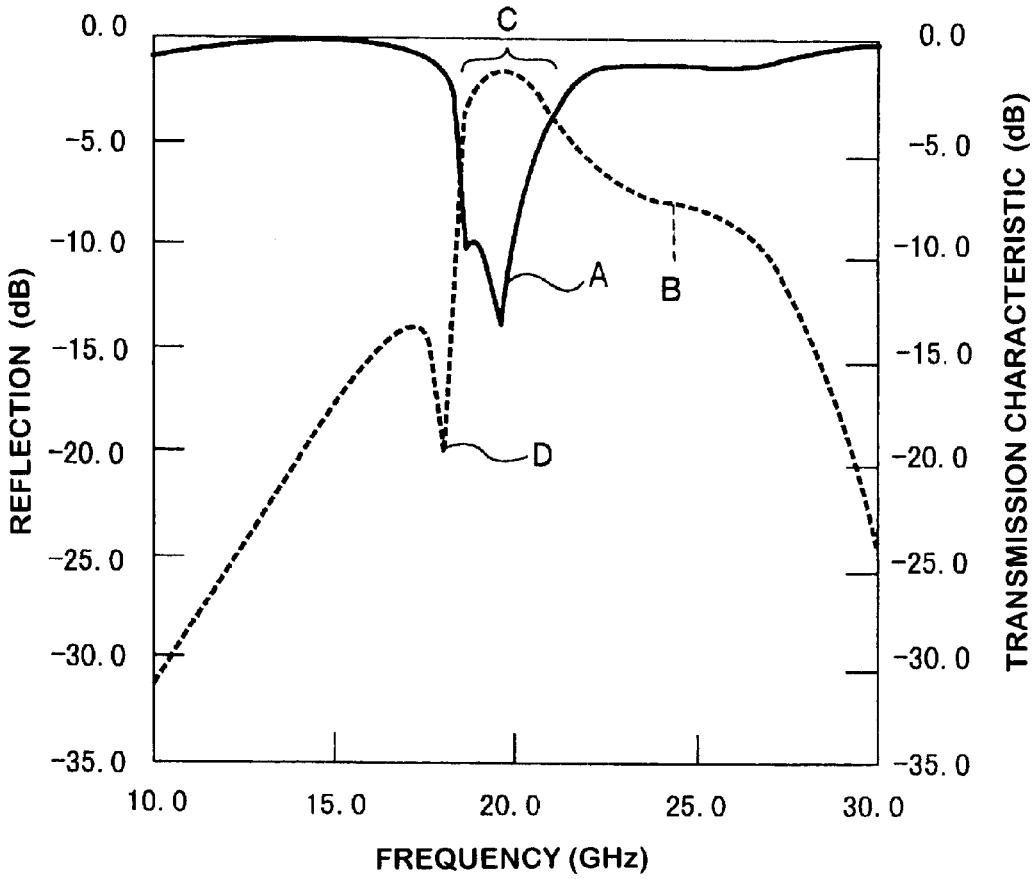
FIG. 3 is a graph showing the frequency characteristic of the dual-mode band-pass filter of the first preferred embodiment of the present invention.

FIG. 3 is a graph showing the frequency characteristics of the dual-mode band-pass filter 1 of this preferred embodiment. In FIG. 3, solid line A represents the reflection characteristic, and broken line B represents the transmission characteristic. In this preferred embodiment, the transmission band of the band-pass filter is denoted by arrow C, as shown in FIG. 3.

In particular, since the frame-shaped electrode-pattern 3 is configured as described above, the two resonance modes are coupled to each other, and therefore, a characteristic required for the dual-mode band-pass filter is obtained. In particular, when an input voltage is applied, the resonance mode propagating in the direction passing through the sides 3*a* and 3*b*, and the resonance mode propagating in the direction passing through the sides 3*a* and 3*b* are generated. In this preferred embodiment, the line-widths of the portions along the sides 3*a* and 3*b* and the line-widths of the portions along the sides 3*c* and 3*d* are selected such that these two resonance modes are degeneration-coupled to each other. In other words, inductance L is loaded in the direction along the sides 3*a* and 3*b* of the frame-shaped electrode-pattern 3. The portion in which resonance current flows in one of the above-described resonance modes is narrowed. Thus, the resonance frequency in this mode is shifted such that the two resonance modes are degeneration-coupled to each other. Accordingly, the band-width C is controlled by the load of the above inductance L.

As described above, in the dual-mode band-pass filter of this preferred embodiment, the line-widths of the frame-shaped electrode-pattern 3 are adjusted such that the two resonance modes are coupled to each other in the portions along the sides 3*a* and 3*b* and the portions along the sides 3*c* and 3*d*. Thereby, a characteristic required for the band-pass filter is effectively and easily obtained, and moreover, the band-width C is easily controlled by adjustment of the size of the above line-widths.

Figure 4:
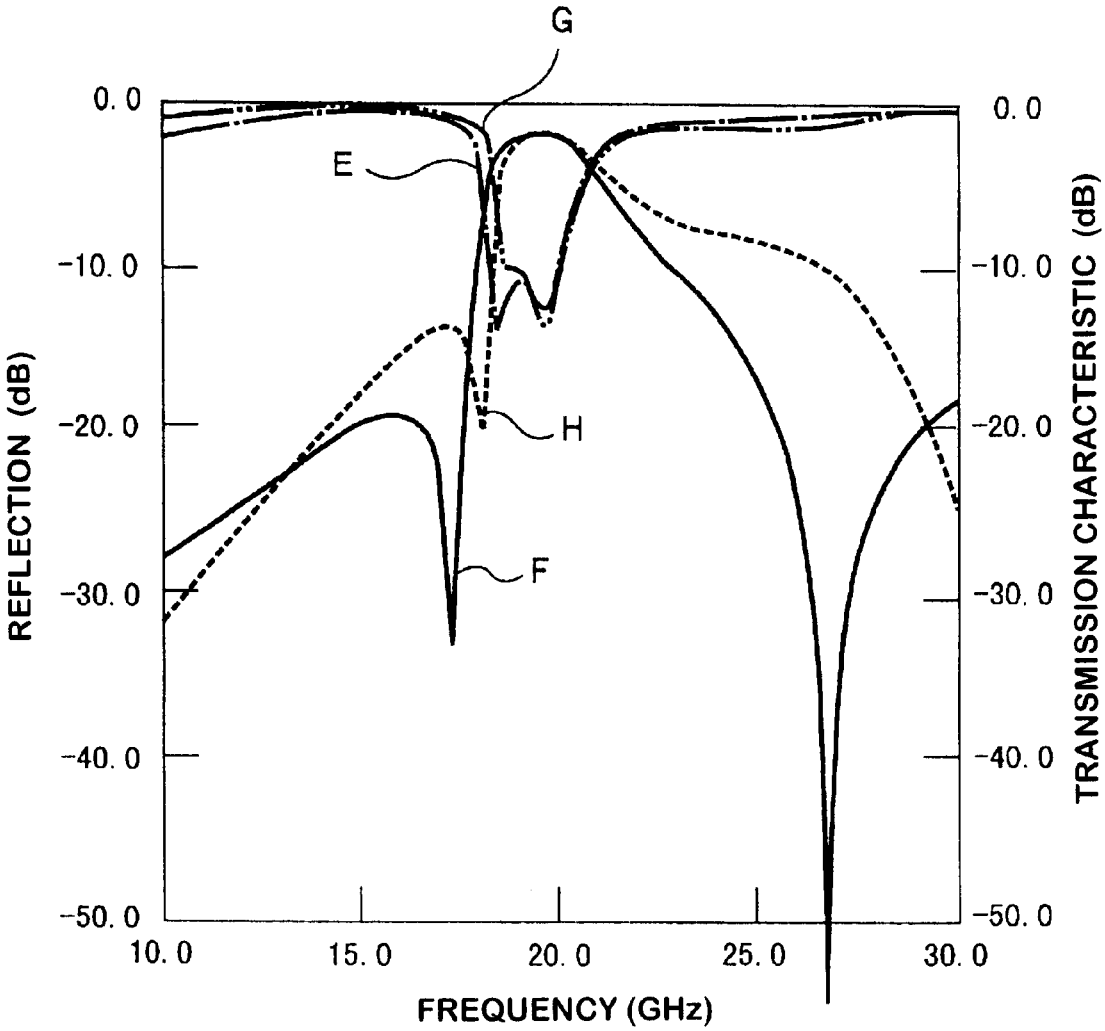
FIG. 4 is a graph showing changes in frequency characteristics of the dual-mode band-pass filter of the first preferred embodiment caused by changing the coupling points of input-output coupling circuits.

Moreover, in the dual-mode band-pass filter of this preferred embodiment, the attenuation pole D of the frequency characteristic shown in FIG. 3 is shifted by changing the coupling positions of the input-output circuits 5 and 6. FIG. 4 illustrates the frequency characteristics obtained when the coupling positions of the input-output circuits 5 and 6 are changed. In FIG. 4, alternate long and short dash line E and solid line F represent the reflection characteristic and the transmission characteristic, respectively, obtained when the coupling points of the input-output coupling circuit electrodes are shifted upward by about 400 $\mu$m along the sides 3*c* and 3*d*. For comparison, alternate long and two short dash line G and broken line H represent the reflection and transmission characteristics shown in FIG. 3.

As seen in FIG. 4, the band-width and the center frequency is easily controlled by changing the positions of the coupling points of the input-output circuits 5 and 6.

Figure 5:
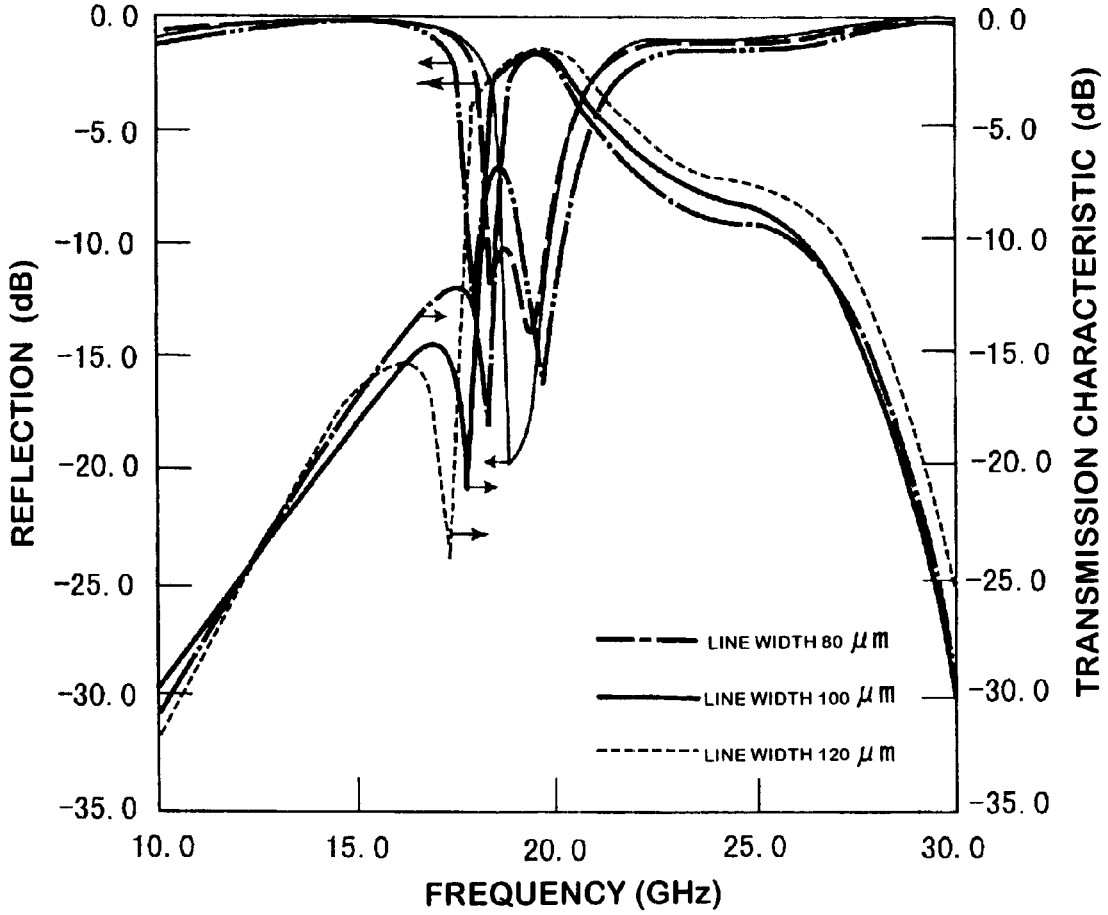
FIG. 5 is a graph showing changes in frequency characteristic of the dual-mode band-pass filter of the first preferred embodiment caused by changing the line-widths of the substantially rectangular frame-shaped metal film.

Moreover, FIG. 5 shows the reflection and transmission characteristics, obtained when the line-widths of the portions along the sides 3*a* and 3*b* are the same as those of the above-described preferred embodiment, and the line-widths of the portions along the sides 3*c* and 3*d* are approximately 80 $\mu$m, 100 $\mu$m, and 120 $\mu$m.

As seen in FIG. 5, the band-widths are easily controlled by changing the line-widths.

Figure 6:
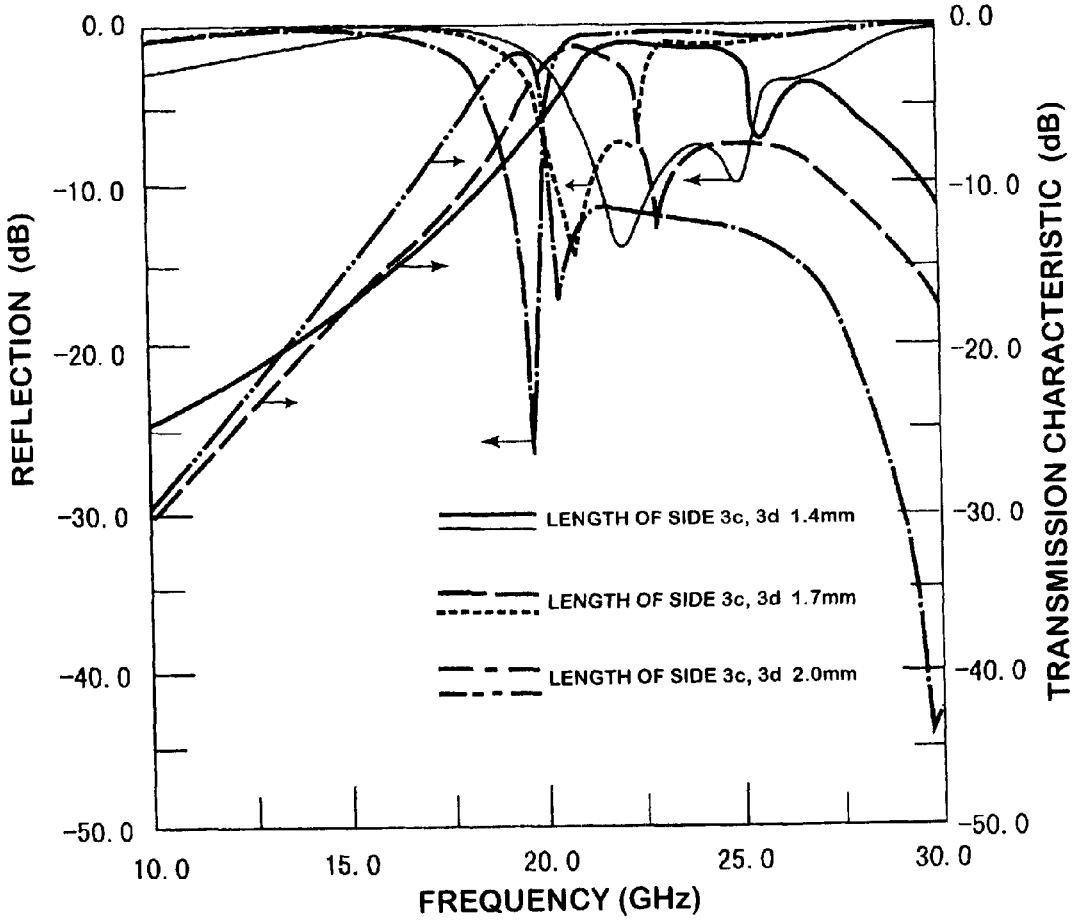
FIG. 6 is a graph showing changes in frequency characteristic of the dual-mode band-pass filter of the first preferred embodiment caused by changing the line-width of the elements along a pair of the sides.

FIG. 6 shows variations in frequency characteristic obtained when the fineness ratio of the frame-shaped electrode pattern 3 of the dual-mode band-pass filter of the first preferred embodiment is changed. FIG. 6 shows the reflection characteristics and the transmission characteristics obtained when the lengths of the sides 3*a* and 3*b* are constant, that is, when the lengths of the sides 3*a* and 3*b* are approximately 2 mm, and the lengths of the sides 3*c* and 3*d* are approximately 1.4 mm, 1.7 mm, and 2.0 mm. In this case, the line-widths of the portions along the sides 3*a* and 3*b* are about 200 $\mu$m, and the line-widths of the portions along the sides 3*c* and 3*d* are about 200 $\mu$m.

As seen in FIG. 6, when the aspect ratio approaches 1, that is, when a substantially square frame-shaped metal film is used as in the first preferred embodiment, the resonance frequencies in the two modes gradually approach one another. In other words, the changes in characteristic shown in FIG. 6 illustrate that the dual-mode band-pass filter is provided by changing the line-widths and the shape of the frame-shaped electrode pattern, using the loading of the inductance as in the first preferred embodiment of the present invention.

As described above, in the dual-mode band-pass filter 1 of this preferred embodiment, the band-width is easily controlled by adjusting the size of the line-width in the frame-shaped electrode-pattern 3, and moreover, the frequency of the attenuation pole is easily controlled by changing the positions of the input-output coupling points.

Thus, a band-pass filter having greatly increased design flexibility is provided.

In addition, it is not necessary that the positions of the coupling points of the input-output coupling circuit electrodes 5 and 6 with respect to the metal film 3 are arranged to define an angle of about 90° relative to the center of the electrode-pattern 3.

In this preferred embodiment, the two resonance modes having different resonance frequencies are coupled to each other by providing an inductance load-component to the line-shaped electrodes at two opposed sides. Similarly, the two resonance modes having difference resonance frequencies may be coupled to each other by providing a capacitance component to two opposed sides.

Figure 7:
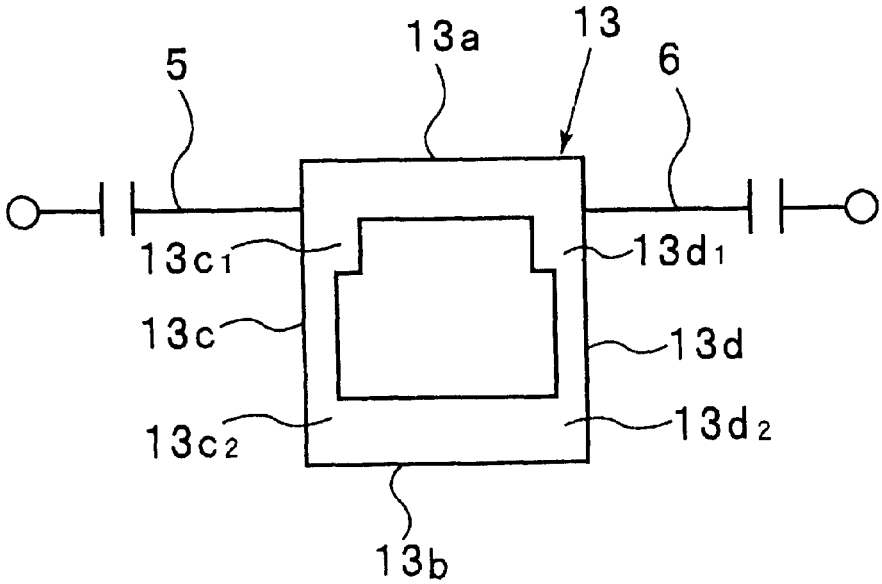
FIG. 7 is a schematic plan view showing the essential portion of a dual-mode band-pass filter according to a second preferred embodiment of the present invention.

FIG. 7 is a schematic plan view showing the essential portion of a dual-mode band-pass filter according to a second preferred embodiment of the present invention. In the second preferred embodiment, the filter is preferably configured in the same manner as the dual-mode band-pass filter 1 of the first preferred embodiment except that the shape of the frame-shaped electrode pattern is different from that of the first preferred embodiment. In particular, in the second preferred embodiment, one pair of sides 13*c* and 13*d* of a frame-shaped electrode pattern 13 that is substantially perpendicular to the other pair of sides 13*a* and 13*b* of the frame-shaped electrode pattern 13 include relatively thick line-width portions $\mathbf{13}c_1$ and $\mathbf{13}d_1$, and relatively thin line-width portions $\mathbf{13}c_2$ and $\mathbf{13}d_2$, respectively. More particularly, the lengths of the sides 13*a* to 13*d* are about 2.0 mm, and the line-widths of the portions along the sides 13*a* and 13*b* are about 200 $\mu$m. In the portions along the sides 13*c* and 13*d*, the line-widths of the relatively thick line-width portions $\mathbf{13}c_1$ and $\mathbf{13}d_1$ are about 200 $\mu$m, and the line-widths of the relatively thin line-width portions along the sides $\mathbf{13}c_2$ and $\mathbf{13}d_2$ are about 50 $\mu$m. Moreover, the lengths of the relatively thin line-width portions $\mathbf{13}c_1$ and $\mathbf{13}d_1$ are about 600 $\mu$m, and those of the relatively thin line-width portions $\mathbf{13}c_2$ and $\mathbf{13}d_2$ are about 1000 $\mu$m. That is, in a pair of the sides 13*c* and 13*d* of the frame-shaped electrode pattern 13, the portions $\mathbf{13}c_1$ and $\mathbf{13}d_1$ to which a capacitance is loaded, and the portions $\mathbf{13}c_2$ and $\mathbf{13}d_2$ to which an inductance is loaded are provided.

Figure 8:
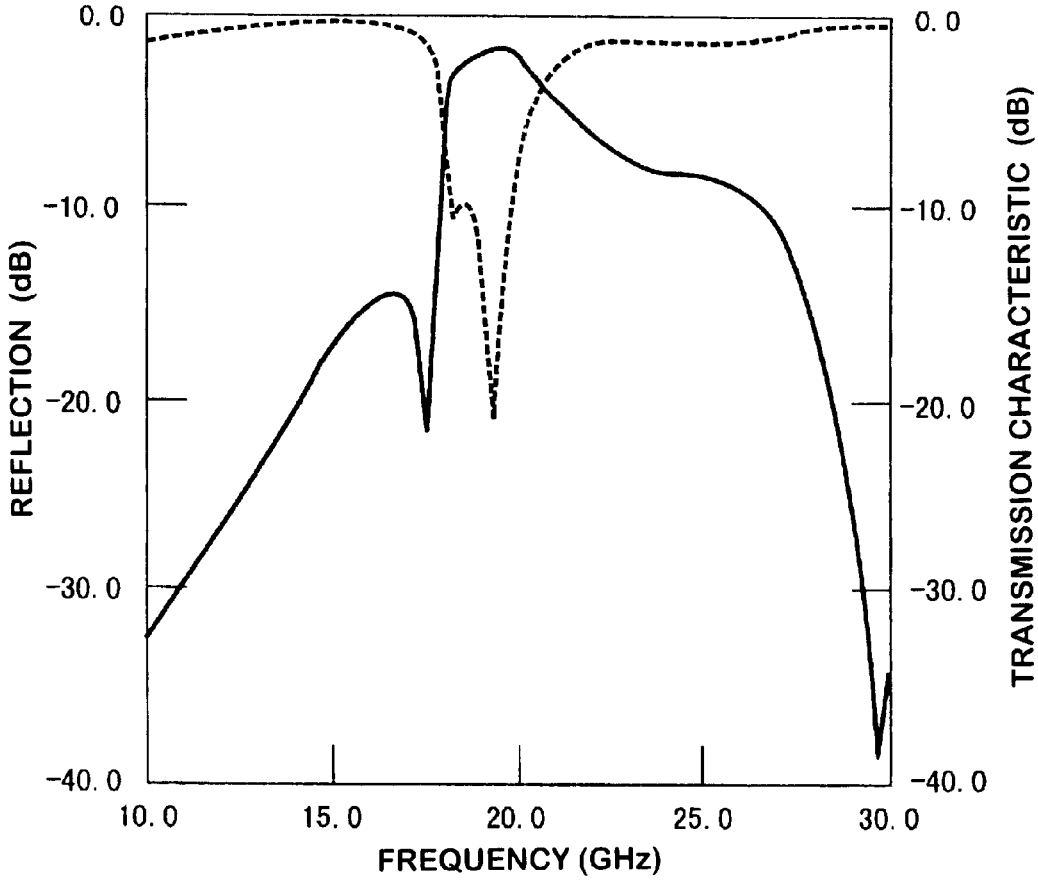
FIG. 8 is a graph showing the frequency characteristic of the dual-mode band-pass filter of the second preferred embodiment of the present invention.

FIG. 8 shows the frequency characteristic of a dual-mode band-pass filter 11 of this preferred embodiment. In FIG. 8, the broken line and the solid line represent the reflection and transmission characteristics, respectively.

According to various preferred embodiments of the present invention, the line-width of the frame-shaped electrode pattern is changed. The characteristics as the band-pass filter can be also obtained by reducing the width of a portion of the sides so as to form the relatively thick line-width portions $\mathbf{13}c_1$ and $\mathbf{13}d_1$ and the relatively thin line-width portions $\mathbf{13}c_2$ and $\mathbf{13}d_2$. In other words, according to preferred embodiments of the present invention, the line-width and the shape of the frame-shaped electrode pattern may be modified in various forms, provided that the two resonance modes, produced in the frame-shaped electrode pattern in this preferred embodiment, are coupled to each other.

Figure 9:
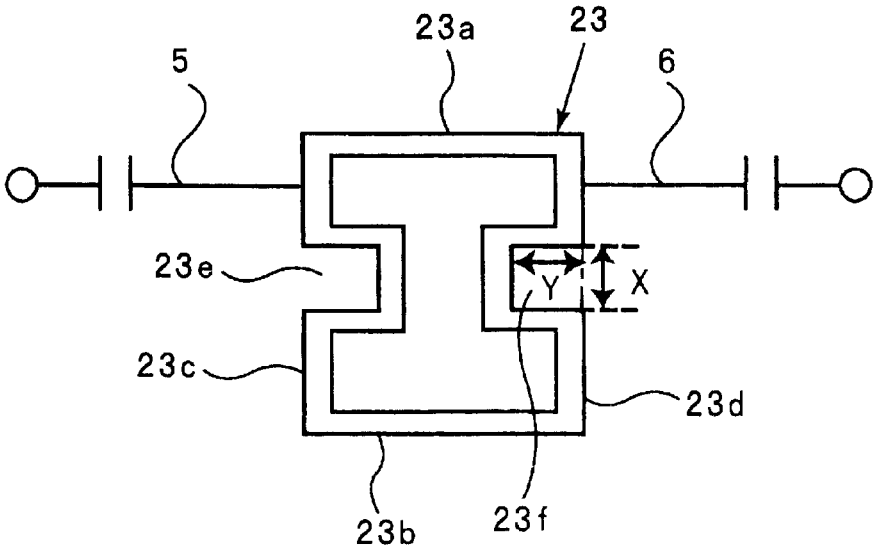
FIG. 9 is a schematic plan view showing the essential portion of the dual-mode band-pass filter of the second preferred embodiment of the present invention.

FIG. 9 is a schematic plan view showing the essential part of the dual-mode band-pass filter according to a third preferred embodiment of the present invention. In the third preferred embodiment, concavities 23*e* and 23*f* are formed in a portion of the sides 23*c* and 23*d* of a frame-shaped electrode pattern 23. The line-widths of the portions along the sides 23*a* and 23*b* are substantially equal to those of the sides 23*c* and 23*d*, that is, they are about 200 μm.

Figure 10:
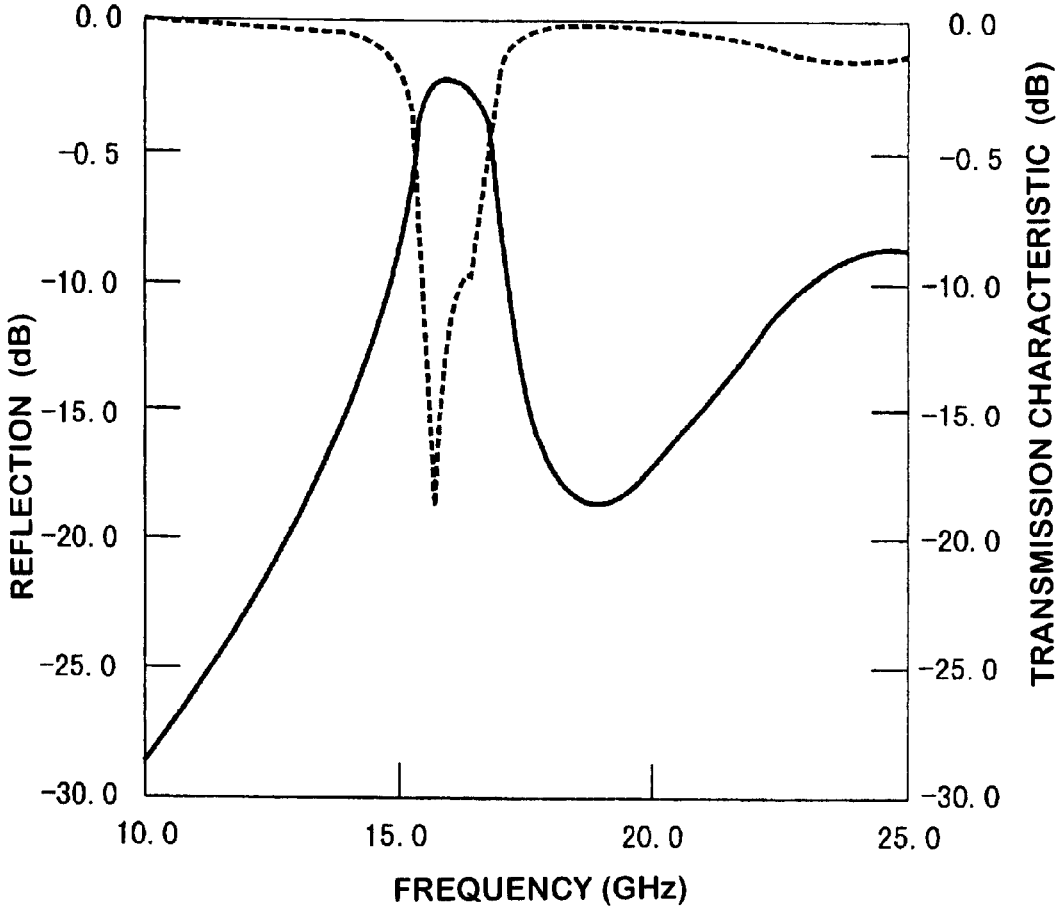
FIG. 10 is a graph showing the frequency characteristic of a dual-mode band-pass filter according to a third preferred embodiment of the present invention.

In this preferred embodiment, since the concave portions 23*e* and 23*f* are provided, the current of the resonance propagating in the direction passing through the sides 23*c* and 23*d* is restrained, and thereby the two resonance modes are coupled to each other. Thus, a characteristic required for the band-pass filter can be obtained. FIG. 10 shows the frequency characteristic of a dual-mode band-pass filter according to a third preferred embodiment of the present invention. The broken line and the solid line represent the reflection and transmission characteristics, respectively. The characteristics are obtained when the width X of the concavities 23*e* and 23*f* (see FIG. 10) is about 400 μm, and the depth Y is about 700 μm.

As seen in FIG. 10, also in the third preferred embodiment, the two resonance modes are coupled to each other, and thereby, a characteristic required for the band-pass filter is obtained.

Figure 11:
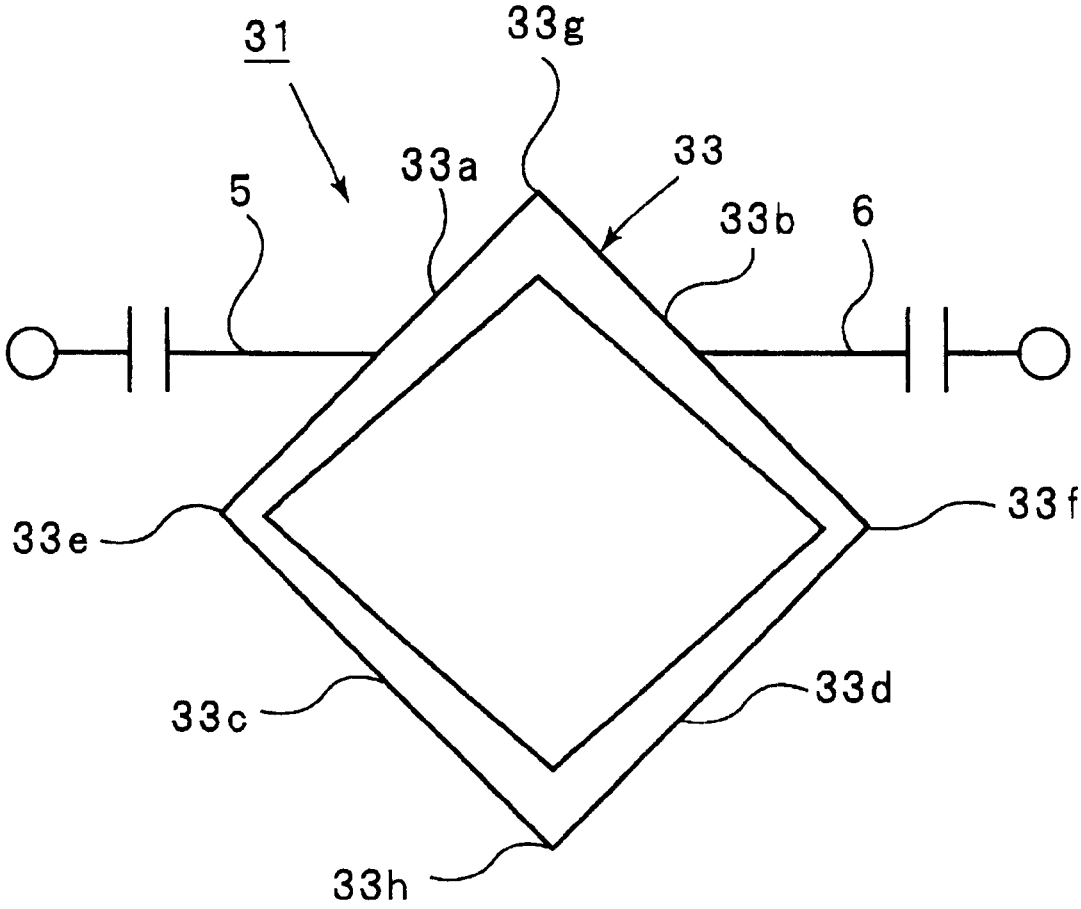
FIG. 11 is a schematic plan view of the essential portion of a dual-mode band-pass filter according to a fourth preferred embodiment of the present invention.

FIG. 11 is a schematic plan view showing the essential part of a dual mode band-pass filter according to a fourth preferred embodiment of the present invention.

In the dual-mode band-pass filter 31 of the fourth preferred embodiment, an electrode pattern 33 having a substantially rhombic outside-shape instead of the substantially rectangular electrode pattern is provided. In the other respects, the configuration is the same as that of the dual-mode band-pass filter 1 of the first preferred embodiment.

In this preferred embodiment, the input-output coupling circuit electrodes 5 and 6 are capacitance-coupled to a portion of the sides 33*a* and 33*b* of a frame-shaped electrode pattern 33. The sides 33*a*, 33*b*, 33*c*, and 33*d* are inclined so that the line-widths become thinner and thinner toward the vertexes 33*e* and 33*f* lying at both of the ends thereof in the lateral direction in FIG. 11. As described above, the line-widths of the portions along the sides 33*a* to 33*d* are made to change gradually so as to define a tapered electrode. Thereby, the two resonance modes are coupled to each other, and a characteristic required for the band-pass filter can be obtained.

The above-described gradation of the line-width is selected so that the resonance mode propagating in the direction passing through the vertexes 33*e* and 33*f* and that propagating in the direction passing through the other two vertexes 33*g* and 33*h* can be coupled to each other.

Figure 12:
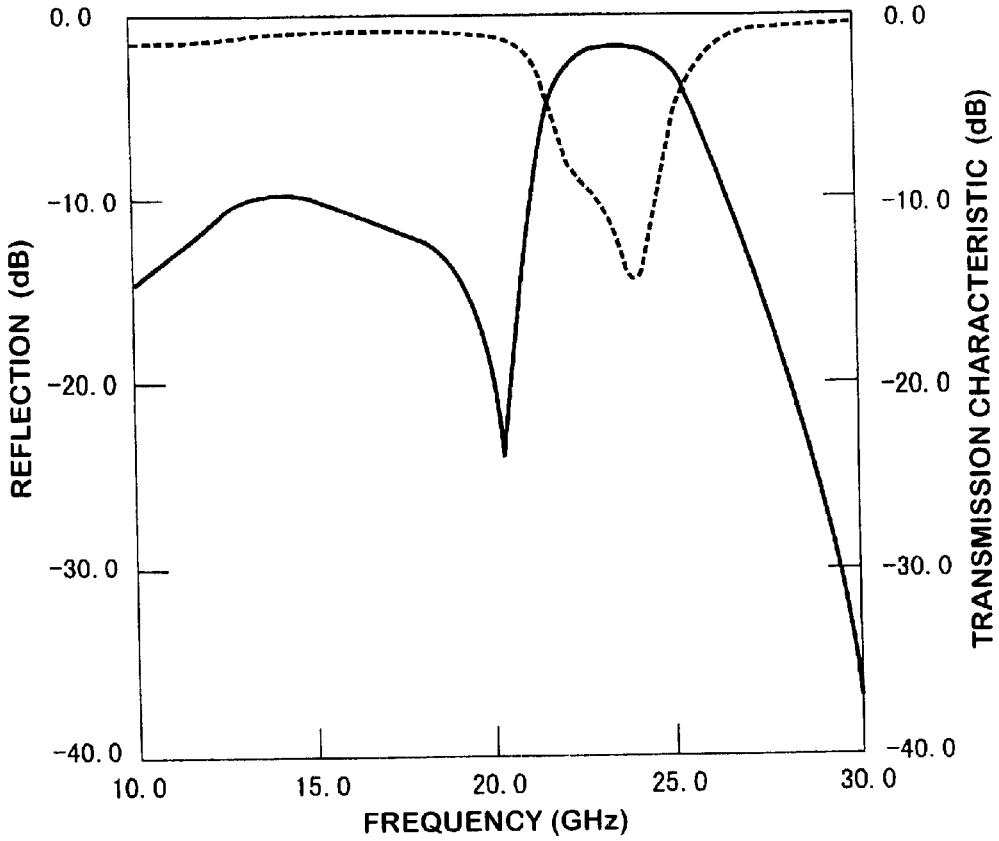
FIG. 12 is a graph showing the frequency characteristic of the dual-mode band-pass filter of the fourth preferred embodiment of the present invention.
Figure 13:
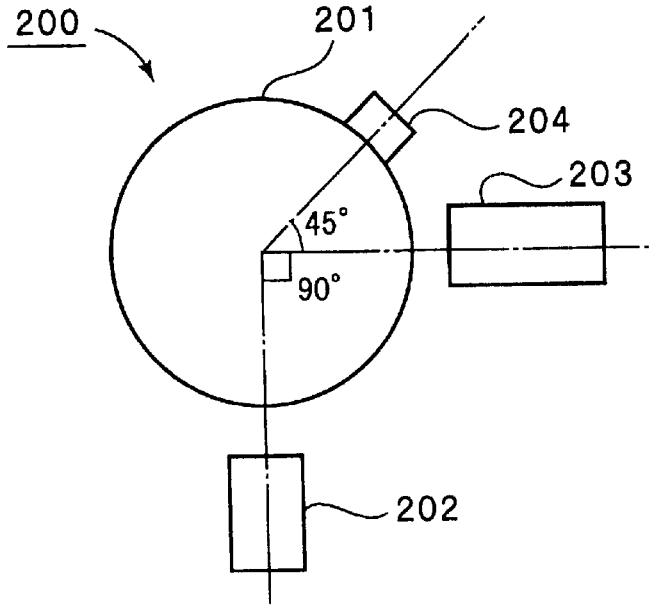
Fig. 13 PRIOR ART
FIG. 13 is a schematic plan view illustrating an example of a conventional dual-mode band-pass filter.
Figure 14:
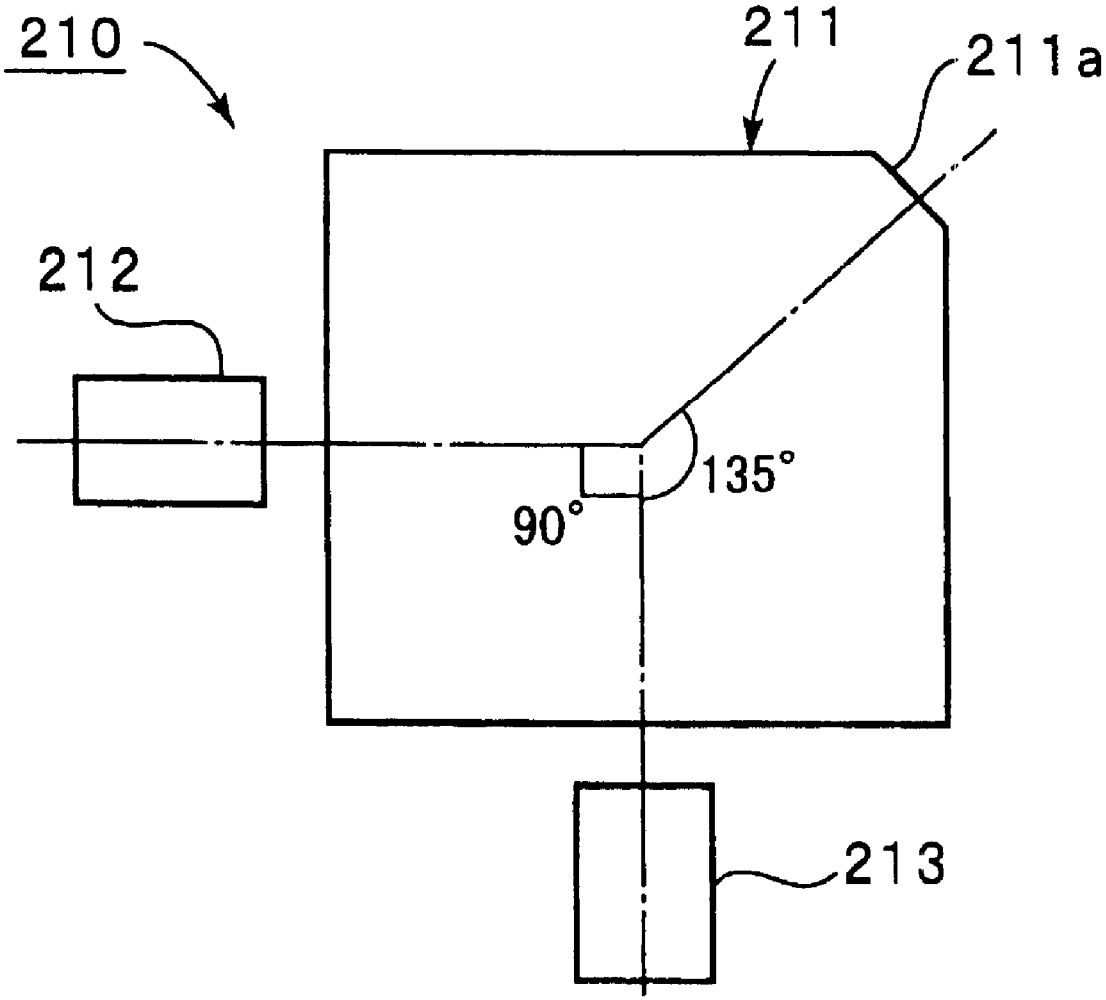
Fig. 14 PRIOR ART
FIG. 14 is a schematic plan view illustrating another example of the conventional dual-mode band-pass filter.

FIG. 12 is a graph showing the frequency characteristic of the dual-mode band-pass filter according to the fourth preferred embodiment. The broken line and solid lines represent the reflection and transmission characteristics, respectively.

The characteristics shown in FIG. 12 are obtained when, regarding the electrode pattern 33, the size in the direction passing through the vertexes 33*e* and 33*f* is about 2.4 mm, the size in the direction passing through the vertexes 33*g* and 33*h* is about 2.4 mm, the line-widths at the vertexes 33*e* and 33*f* are about 100 μm, and the line-widths at the vertexes 33*g* and 33*h* are about 200 μm.

As seen in FIG. 12, also in the preferred embodiment, the two resonance modes having different resonance frequencies from each other are coupled, so that a characteristic required for the band-pass filter can be obtained.

Also in the fourth preferred embodiment, the two resonance modes are coupled to each other by changing the line-width and shape of the electrode pattern 33, as well as in the first preferred embodiment. Thus, the frequency of the attenuation pole can be controlled by shifting the coupling points of the input-output circuits 5 and 6. Moreover, the band-width can be easily controlled by changing the line-width and the shape. Furthermore, the input-output circuits 5 and 6 do not always need to be arranged so as to define a center angle of 90° with respect to the center of the metal film 33. Accordingly, the design flexibility for the dual-mode band-pass filter can be significantly enhanced, as in the first preferred embodiment.

Figure 15:
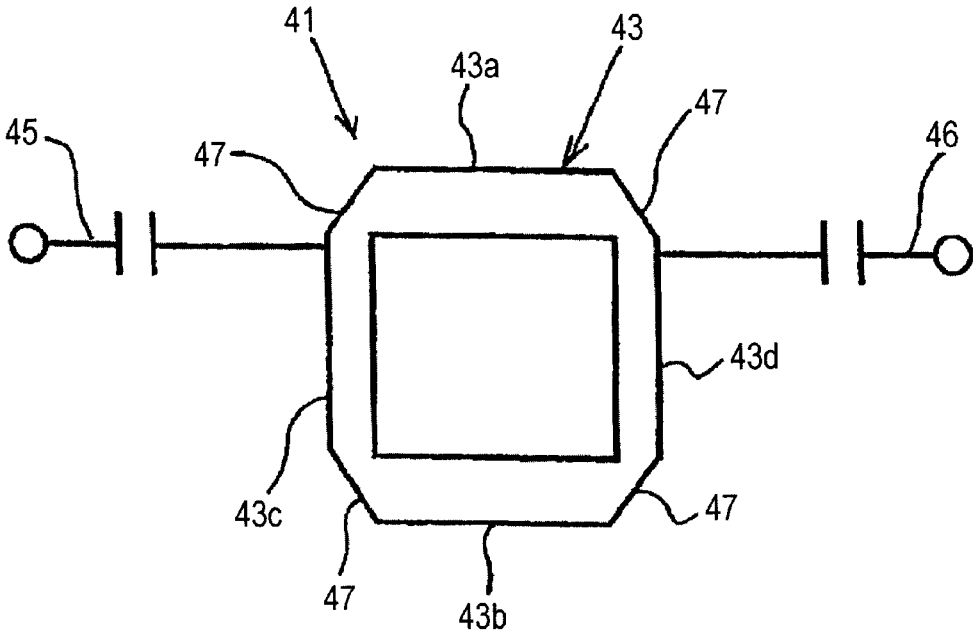
FIG. 15 is a schematic plan view showing the essential portion of a dual-mode band-pass filter according to a fifth preferred embodiment of the present invention.

FIG. 15 is a plan view of a dual-mode band-pass filter according to a fifth preferred embodiment of the present invention. Similarly to the dual-mode band-pass filter of the first preferred embodiment, a dual-mode band-pass filter 41 has a substantially rectangular electrode pattern 43 having four line-shaped electrodes 43*a* to 43*d*. Input-output coupling circuit electrodes 45 and 46 are coupled to the line-shaped electrode 43*c* and 43*d* via capacitors, respectively.

If the frame-shaped electrode pattern is substantially circular, the velocities of a current flowing in the inner-edge and outer-edge sides of the circle are different from each other. That is, this current velocity difference causes the loss of a high frequency signal. To the contrary, in this preferred embodiment, since the electrode pattern 43 is a substantially rectangular electrode pattern having the four line-shaped electrodes, the velocities of currents flowing in the inner and outer edge sides of the four sides are the same. In this portion, substantially no loss of a high frequency is caused.

The four corners of the frame-shaped electrode pattern 43 are bend-worked so that the outer edge shapes of the respective corner portions become polygonal. Thereby, a high frequency signal can be easily transmitted there. That is, the difference between the current velocities in the inner edge and outer edge sides of the frame-shaped electrode pattern can be adjusted in these corner portions. Moreover, since the current velocity difference is adjusted in the four corner portions, the adjustment can be easily performed as compared with that of the substantially circular electrode pattern.

The four corner portions 47 may be R-worked so that the outer edges have a curved line shape.

In the case in which the outer edges of the corner portions 47 are bend-worked, the capacitances in the relevant portions are changed. Thus, the resonance frequency is enhanced. However, the insertion loss is sufficiently reduced, so that the characteristic required for the band pass filter is improved. That is, the bend-working of the outer edges satisfactorily improves the signal loss.

In the dual-mode band-pass filter of preferred embodiments of the present invention, the line-width and shape of the frame-shaped electrode pattern is selected so that the two resonance modes produced in the frame-shaped electrode pattern constituting a resonator can be coupled to each other. Therefore, when an input voltage is applied via the input-output coupling circuit electrodes, the two resonance modes produced in the frame-shaped electrode pattern are coupled. Thus, a characteristic required for the band-pass filter can be obtained. In this case, the attenuation pole can be easily controlled by adjustment of the positions of the coupling points of the input-output coupling circuit electrodes. Moreover, the band-width can be easily controlled by adjusting the line-width and shape of the frame-shaped electrode pattern, that is, by loading a capacitance or inductance component to the line-shaped electrodes. Furthermore, the positions of the coupling points of the input-output circuits with respect to the metal film are not particularly limited.

Accordingly, a desired band-width and frequency characteristic is easily produced, and the design flexibility for the dual-mode band-pass filter is significantly improved.

While the present invention has been particularly shown and described with reference to preferred embodiments thereof, it will be understood by those skilled in the art that the foregoing and other changes in form and details can be made without departing from the spirit and scope of the present invention.

What is claimed is:

1. A dual-mode band-pass filter comprising:

a dielectric substrate;

an electrode pattern disposed on one main surface of the dielectric substrate or inside the dielectric substrate, said electrode pattern including a line-shaped electrode having a substantially constant line-width from a starting point to an end point thereof;

a ground electrode disposed inside the dielectric substrate or on a main surface of the dielectric substrate so as to be opposed to the electrode pattern via a portion of the dielectric substrate;

input-output coupling circuit electrodes coupled to the electrode pattern; and at least one of a capacitance loading portion and an inductance loading portion is disposed in a portion of the line-shaped electrode so that two resonance modes having different resonance frequencies and being generated at the electrode pattern are coupled to each other; wherein said electrode pattern is a substantially rectangular electrode pattern having four sides; and the electrode widths of two adjacent sides of the four sides are different from each other, and the electrode widths of two opposed sides of the four sides are the same.

2. The dual-mode band-pass filter according to claim 1, wherein the electrode pattern has a frame-shaped configuration.

3. The dual-mode band-pass filter according to claim 1, wherein at least one of said capacitance loading portion and said inductance loading portion is located in two opposed sides of the four sides.

4. The dual-mode band-pass filter according to claim 1, wherein at least one corner portion of the substantially rectangular electrode pattern has a surface that has been bend-worked or R-worked.

5. A dual-mode band-pass filter comprising:

a dielectric substrate;

an electrode pattern disposed on one main surface of the dielectric substrate or inside the dielectric substrate, said electrode pattern including a line-shaped electrode having a substantially constant line-width from a starting point to an end point thereof;

a ground electrode disposed inside the dielectric substrate or on a main surface of the dielectric substrate so as to be opposed to the electrode pattern via a portion of the dielectric substrate;

input-output coupling circuit electrodes coupled to the electrode pattern; and at least one of a capacitance loading portion and an inductance loading portion is disposed in a portion of the line-shaped electrode so that two resonance modes having different resonance frequencies and being generated at the electrode pattern are coupled to each other; wherein said electrode pattern is a substantially rectangular electrode pattern having four sides; and the electrode lengths of two adjacent sides of the four sides are different from each other, and the electrode lengths of two opposed sides of the four sides are the same.

6. A dual-mode band-pass filter comprising:

a dielectric substrate;

an electrode pattern disposed on one main surface of the dielectric substrate or inside the dielectric substrate, said electrode pattern including a line-shaped electrode having a substantially constant line-width from a starting point to an end point thereof;

a ground electrode disposed inside the dielectric substrate or on a main surface of the dielectric substrate so as to be opposed to the electrode pattern via a portion of the dielectric substrate;

input-output coupling circuit electrodes coupled to the electrode pattern; and at least one of a capacitance loading portion and an inductance loading portion is disposed in a portion of the line-shaped electrode so that two resonance modes having different resonance frequencies and being generated at the electrode pattern are coupled to each other; wherein said electrode pattern is a substantially rectangular electrode pattern having four sides; and the electrode pattern including at least one side of the four sides has a tapered shape.

7. A dual-mode band-pass filter comprising:

a dielectric substrate;

an electrode pattern disposed on one main surface of the dielectric substrate or inside the dielectric substrate, said electrode pattern including a line-shaped electrode having a substantially constant line-width from a starting point to an end point thereof;

a ground electrode disposed inside the dielectric substrate or on a main surface of the dielectric substrate so as to be opposed to the electrode pattern via a portion of the dielectric substrate;

input-output coupling circuit electrodes coupled to the electrode pattern; and at least one of a capacitance loading portion and an inductance loading portion is disposed in a portion of the line-shaped electrode so that two resonance modes having different resonance frequencies and being generated at the electrode pattern are coupled to each other; wherein said electrode pattern is a substantially rhombic electrode pattern having four sides; and the electrode widths of two adjacent sides of the four sides are different from each other, and the electrode widths of two opposed sides of the four sides are the same.

8. The dual-mode band-pass filter according to claim 7, wherein at least one corner portion of the substantially rectangular electrode pattern has a surface that has been bend-worked or R-worked.

9. A dual-mode band-pass filter comprising:

a dielectric substrate;

an electrode pattern disposed on one main surface of the dielectric substrate or inside the dielectric substrate, said electrode pattern including a line-shaped electrode having a substantially constant line-width from a starting point to an end point thereof;

a ground electrode disposed inside the dielectric substrate or on a main surface of the dielectric substrate so as to be opposed to the electrode pattern via a portion of the dielectric substrate;

input-output coupling circuit electrodes coupled to the electrode pattern; and at least one of a capacitance loading portion and an inductance loading portion is disposed in a portion of the line-shaped electrode so that two resonance modes having different resonance frequencies and being generated at the electrode pattern are coupled to each other; wherein said electrode pattern is a substantially rhombic electrode pattern having four sides; and at least one of said capacitance loading portion and said inductance loading portion is located in two opposed sides of the four sides.

10. A dual-mode band-pass filter comprising:

a dielectric substrate;

an electrode pattern disposed on one main surface of the dielectric substrate or inside the dielectric substrate, said electrode pattern including a line-shaped electrode having a substantially constant line-width from a starting point to an end point thereof;

a ground electrode disposed inside the dielectric substrate or on a main surface of the dielectric substrate so as to be opposed to the electrode pattern via a portion of the dielectric substrate;

input-output coupling circuit electrodes coupled to the electrode pattern; and at least one of a capacitance loading portion and an inductance loading portion is disposed in a portion of the line-shaped electrode so that two resonance modes having different resonance frequencies and being generated at the electrode pattern are coupled to each other; wherein said electrode pattern is a substantially rhombic electrode pattern having four sides; and the electrode lengths of two adjacent sides of the four sides are different from each other, and the electrode lengths of two opposed sides of the four sides are the same.

11. A dual-mode band-pass filter comprising:

a dielectric substrate;

an electrode pattern disposed on one main surface of the dielectric substrate or an electrode pattern disposed on one main surface of the dielectric substrate or inside the dielectric substrate, said electrode pattern including a line-shaped electrode having a substantially constant line-width from a starting point to an end point thereof;

a ground electrode disposed inside the dielectric substrate or on a main surface of the dielectric substrate so as to be opposed to the electrode pattern via a portion of the dielectric substrate;

input-output coupling circuit electrodes coupled to the electrode pattern; and at least one of a capacitance loading portion and an inductance loading portion is disposed in a portion of the line-shaped electrode so that two resonance modes having different resonance frequencies and being generated at the electrode pattern are coupled to each other; wherein said electrode pattern is a substantially rhombic electrode pattern having four sides; and the electrode pattern including at least one side of the four sides has a tapered shape.

* * * * *